United States Patent [19]

Nagano et al.

[11] Patent Number: 4,825,181

[45] Date of Patent: Apr. 25, 1989

[54] SWITCHING DEVICE

[75] Inventors: Suketoshi Nagano, Yokohama; Munehiro Ichikawa; Takashi Yoneyama, both of Kawasaki, all of Japan

[73] Assignee: Kabushiki Kaisha Toshiba, Kawasaki, Japan

[21] Appl. No.: 163,560

[22] Filed: Mar. 3, 1988

[30] Foreign Application Priority Data

Mar. 10, 1987 [JP] Japan ..... 62-54651
Mar. 20, 1987 [JP] Japan ..... 62-67211

[51] Int. Cl.[4] ..... H01H 9/00
[52] U.S. Cl. ..... 335/205; 340/623
[58] Field of Search ..... 200/84 L; 335/153, 205-207; 340/623-624; 73/305, 309, 311

[56] References Cited

U.S. PATENT DOCUMENTS 3,448,419 6/1969 Myatt ..... 335/206
3,544,934 5/1969 Poliakoff ..... 335/206
4,107,493 8/1978 Nagara et al. ..... 340/624

FOREIGN PATENT DOCUMENTS 3447363 12/1984 Fed. Rep. of Germany .
2488439 8/1980 France .
565445 3/1974 Sweden .
7816880 1/1979 United Kingdom .
8503682 8/1983 World Int. Prop. O. .

OTHER PUBLICATIONS

Shipbuilding & Engineering, vol. 18, No. 11/Nov. 1985.

*Primary Examiner*—E. A. Goldberg
*Assistant Examiner*—Lincoln Donovan
*Attorney, Agent, or Firm*—Oblon, Fisher, Spivak, McClelland & Maier

[57] ABSTRACT

A switching device comprising a reed switch of a normal open type turned on and off by a magnetic field, a fixed bias magnet located in an area where the switch operates stably, and a starting magnet located opposite to the fixed bias magnet with the switch interposed between them and capable of applying a magnetic field, reverse to that of the fixed bias magnet, to the switch. When the starting magnet is carried close to the switch, its a magnetic field overcomes that of the fixed bias magnet to control the switching-on and -off of the switch, and when it is carried remote from the swtich, the fixed bias magnet controls the switching-on and -off of the switch.

10 Claims, 5 Drawing Sheets

SWITCHING DEVICE

BACKGROUND OF THE INVENTION

1. Field of the Invention

The present invention relates to a switching device for use with sea rescue systems such as a radio buoy, radar transponder (SART) and emergency position report radio beacon (EPIRB) which uses a satellite.

2. Description of the related art

As well known, the sea rescue systems must meet standards provided by IMO (International Marine Affairs Organization), ITU (International Tele-communication Union) and the like. In addition, they must satisfy various kinds of regulations provided by Classification Societies. Those technical provisions, which are associated with the switching device, of these standards and regulations include the following sentences in addition to the common provisions.

(1) Its machinery and tools shall be reliable under any extreme conditions.

(2) It shall be provided with appropriate means for preventing it from being mistakenly made operative.

(3) It shall have such a water-tight arrangement as to be durable for five minutes at a depth of 10 m in the sea (its electric circuit shall be durable against destructive influences caused by freeze and water leakage).

(4) It shall be automatically operated.

(5) It shall be manually operated and stopped (It may be so through remote control).

(6) It shall be easily tested (without transmitting signals).

(7) It shall not be damaged even when it is dropped from the height of 20 m into the sea.

(8) While it is on board, it shall be normally operated even if shock and vibration usually added to the decks of navigating ships exceed a certain range.

The mercury switch (or inverted switch) can be cited as the switching mechanism which is often used with the conventional systems under the above-mentioned conditions. This mercury switch used mercury contacts and when the system is turned right side up on the sea or in its container, the mercury switch is closed to automatically start the system. When it is to be stopped, the system is turned upside down. In other words, the system is housed upside down in the container.

When the system is set like this, however, the following problems are caused.

(1) It is likely to be led to malfunction by forces such as shock, vibration and shake applied from outside.

(2) It cannot be easily tested (or operated) (by one touch of finger).

(3) It is likely to be mistakenly operated.

This is because the system must be set upside down because of the structure of the mercury switch in the case of the switching device for use with the conventional sea rescue systems.

SUMMARY OF THE INVENTION

The present invention is therefore intended to eliminate the above-mentioned drawbacks and the object of the present invention is to provide a switching device most suitable for use with the sea rescue systems and capable of providing such advantages that the system is unlikely to be lead to malfunction by forces such as shock, vibration and shake applied from outside, that it can be easily tested (or operated) and that it is unlikely to be mistakenly operated.

DETAILED DESCRIPTION OF THE PREFERRED EMBODIMENT

An embodiment of the switching device according to the present invention will be described with reference to the accompanying drawings.

Figure 1:
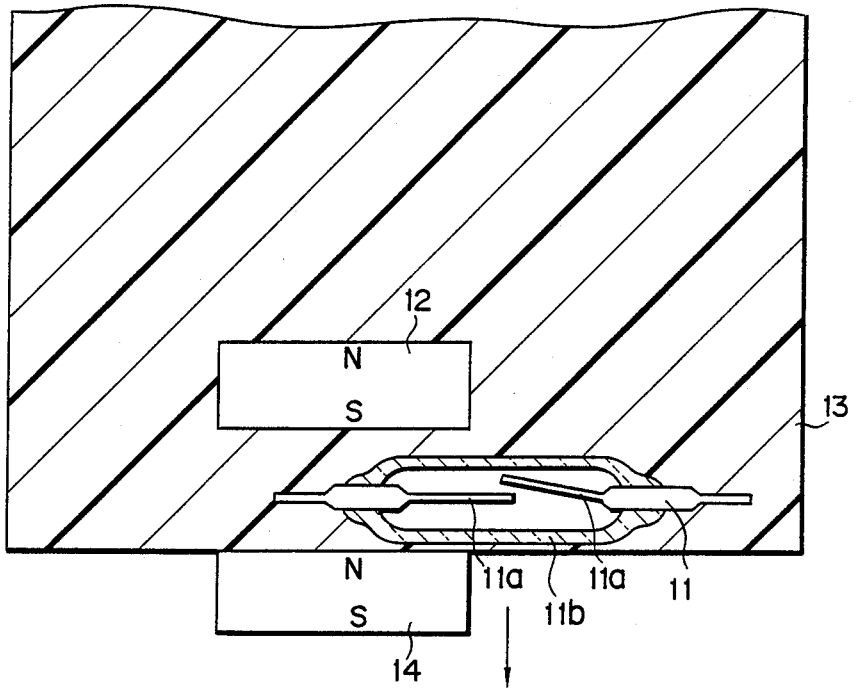
FIG. 1 is a sectional view showing a first embodiment of the switching device according to the present invention.

FIG. 1 shows the switching device and in FIG. 1, numeral 11 represents a magnetic reed switch and 12 a fixed bias magnet. These reed switch 11 and fixed bias magnet 12 are embedded and fixed in body or mold member 13 made of resin. Reed switch 11 is embedded in mold member 13 in such a way that it is adjacent and parallel to a flat surface of mold member 13, while fixed bias magnet 12 is remoter from, and parallel to, the flat surface of mold member 13.

Reed switch 11 comprises a pair of strip reed terminals 11*a* serving as contacts and made of magnetic material, and elongated glass tube 11*b* for sealing these terminals 11*a* therein. The base ends of the reed terminals are fixed to both ends of glass tube 11*b*, respectively, and a contact is formed on a free end side of each of reed terminals 11*a*. These contacts face each other in the center of glass tube 11*b* with a certain interval interposed between them. This reed switch 11 is therefore of the normal open type, keeping its contacts opened when it is not excited. Fixed bias magnet 12 is a permanent magnet located nearer one end of reed switch 11 or eccentric to the contacts thereof. This fixed bias magnet 12 has flat sides each substantially parallel to the flat surface of mold member 13 and the one side thereof which is nearer reed switch 11 is made as S polarity while the other as N polarity. This plate-like permanent magnet is more common and operates with more stability, as compared with the rod-like magnet shown in FIG. 2. The plate-like magnet is therefore more preferable to achieve such an operation as will be described later. Reed terminals 11*a* of reed switch 11 are excited in the magnetic field of fixed bias magnet 12 and their contacts are thus usually closed.

Starting magnet 14 is located on the flat surface of mold member 13, facing fixed bias magnet 12 and sandwiching an end of reed switch 11 between them. Starting magnet 14 has flat sides each substantially parallel to the flat surface of mold member 13 and the one side thereof which is nearer reed switch 11 is made as N polarity while the other as S polarity. Attraction is caused between starting magnet 14 and fixed bias magnet 12 so that starting magnet 14 can be usually located on the flat surface of mold member 13, as shown in FIG. 1. The magnetic field of fixed bias magnet 12 is offset by that of starting magnet 14 under this state, thereby keeping the contacts of reed switch 11 opened. Starting magnet 14 can be moved, by force applied from outside, in a direction as shown by an arrow in FIG. 1, that is, in a direction in which it departs from the flat surface of mold member 13 or in a direction substantially perpendicular to the longitudinal direction of the terminals, and when it departs from the flat surface of mold member 13, reed switch 11 is closed by the magnetic field of fixed bias magnet 12.

Figure 2:
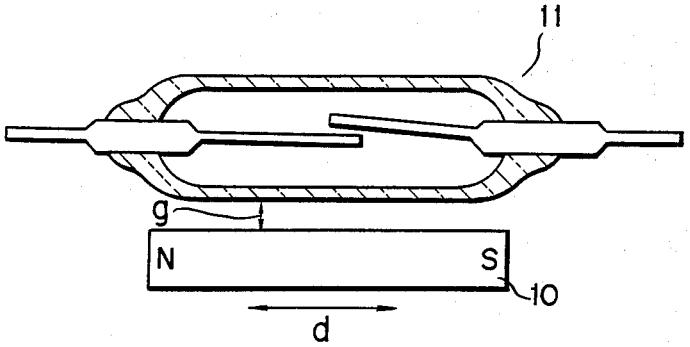
FIG. 2 is a view for illustrating an arrangement of a magnet relative to a reed switch.

The reason why fixed bias and starting magnets 12 and 14 are located at one end of reed switch 11 will be described referring to FIG. 2.

Figure 3:
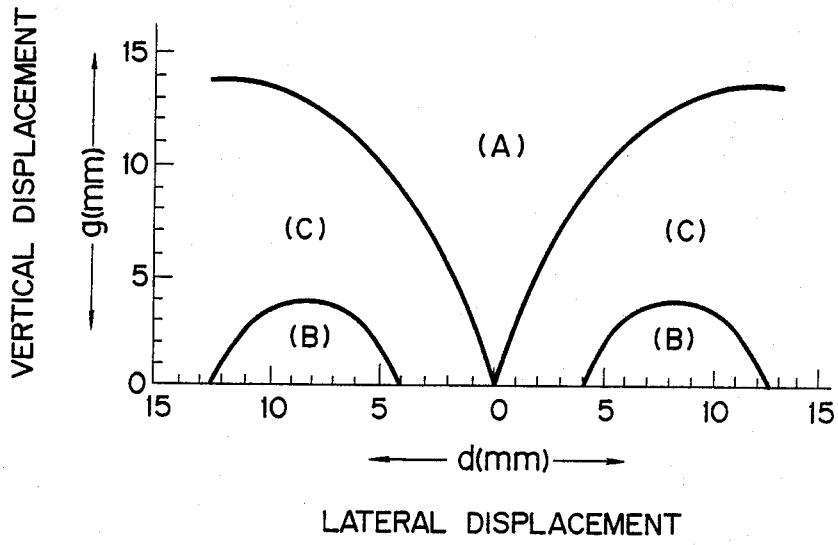
FIG. 3 is a diagram intended to explain the arrangement and position of the magnet.

The operation of reed switch 11 which had the above-described arrangement was checked, moving permanent magnet 10, which was N-polarized at one end thereof and S-polarized at the other end, in the longitudinal direction (or direction d) and traverse direction (or direction g) of reed switch 11. FIG. 3 shows results thus obtained. The lateral axis denotes distances of permanent magnet 10 shifted in the longitudinal direction of reed switch 11 while the vertical axis those of permanent magnet 10 shifted in the traverse direction thereof. Symbol A represents an opened area where the terminals of reed switch 11 are opened, symbol B stable operation areas where they are stably closed, and symbol C unstable operation areas where they are opened and closed. Considering these results obtained, fixed bias and starting magnets 12 and 14 are usually located not in the center of reed switch 11 but at one end thereof, that is, in the stable operation area. When starting magnet 14 is moved out of the stable operation area and into the unstable operation area, reed switch is closed.

Figure 4:
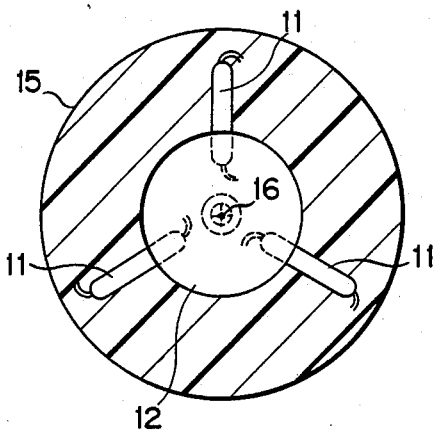
FIGS. 4 and 5 are longitudinal and cross-sectional views showing a sea rescue system into which the first embodiment of the switching device is incorporated.
Figure 5:
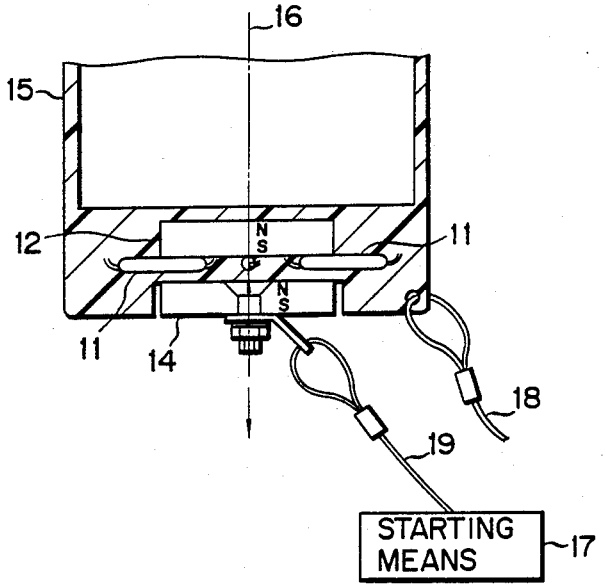

A sea rescue safety system into which the switching device having the above-described arrangement is incorporated will be described with reference to FIGS. 4 and 5.

Numeral 15 denotes a cylindrical body case (which corresponds to mold member 13) made of transparent resin. Plural (or three in this embodiment) magnetic reed switches 11 are embedded in the bottom of body case 15 in such a manner that they are separated a little from and radially arranged round center axis 16 of body case 15 with a certain interval interposed between them. These reed switches 11 are connected to electric circuits and used as power source switches for three kinds of power sources, for example. Fixed disk-like bias magnet 12 is also embedded, coaxial to the center axis, in the bottom of body case 15. Fixed bias magnet 12 is located above reed switches 11 and has such a diameter as to overlap an end of each of reed switches 11. The underside of fixed bias magnet 12 (which is nearer reed switches 11) is S-polarized and the top thereof is N-polarized.

Circular recess 15*a* is formed in the underside of the bottom of body case 15 and starting magnet 14, similar in shape to fixed bias magnet 12, is coaxially located in the recess. Starting magnet 14 is made as N polarity at the upper side thereof and as S polarity at the lower side thereof. Attraction is thus caused between starting and fixed bias magnets 14 and 12, thereby causing starting magnet 14 to be attracted into recess 15*a*. Similarly described with reference to FIG. 1, reed switches 11, fixed bias magnet 12 and starting magnet 14 are designed in such a way that when starting magnet 14 is attracted in recess 15*a* as shown in FIG. 5, reed switches 11 are opened and that when it is moved in a direction shown by an arrow in FIG. 5, they are closed. An end of operation starting rope 19 is screwed to starting magnet 14 and the other end thereof is provided with operation starting means 17. An end of holder rope 18 is connected to body case 15 and the other end thereof to operation starting rope 19. As the result, even when starting magnet 14 is separated from body case 15 by operation starting rope 19 pulled, it is not lost and can be attached to body case 15 again.

In the case of the sea rescue safety system having the above-described arrangement, the electric field of fixed bias magnet 12 which acts on reed switches 11 is offset by that of starting magnet 14 when starting magnet 14 is attached to body case 15. Reed switches 11 are all opened accordingly. When the operation starting rope is then pulled by operating starting means, starting magnet 14 is separated from body case 15, that is, from reed switches 11. Reed switches 11 are all closed this time because they are in the electric field of fixed bias magnet 12. Three lines of electric circuits can be thus made operative through reed switches 11. When starting magnet 14 is returned to its original position, these electric circuits can be turned off.

The above-described sea rescue safety system can be automatically operated as follows, for example, at the time of shipwreck.

(1) Operation starting rope 19 is pulled by the expanding of a life boat which is of the expansion type.

(2) A weight is connected to operation starting rope 19 and caused to pull operation starting rope 19 by the action of the system which falls as well at the time of shipwreck.

(3) A seaman jumps into the sea, carrying the system on his back, at the time of shipwreck, to thereby pull starting rope 19.

When the sea rescue safety system is made using the switching device of the present invention, therefore, it is unlikely to be lead to malfunction by forces such as shock, vibration and shake applied from outside. It can also be easily tested (or operated). In addition, it is unlikely to be mistakenly operated.

A second embodiment of the switching device will be described referring to FIG. 6. Substantially same parts as those in the first embodiment will be denoted by same numerals and description on these parts will be omitted.

Two reed switches 11 of the normal open type are used in this second embodiment. Reed switches 11 which are electrically connected at their one ends and thus connected each other in series are embedded, parallel to each other, in mold member 13. Closed chamber 13*a* is formed, adjacent to and above first reed switch 11, in mold member 13. First starting magnet 14*a* is housed in closed chamber 13*a* in such a manner that it can move to and from first reed switch 11 in upward and downward directions (shown by arrows in FIG. 6). First starting magnet 14*a* is shaped like a plate and it is S-polarized at the lower side thereof while N-polarized at the upper side thereof. An open chamber 13*b* is formed, adjacent to and below second reed switch 11, in mold member 13. This open chamber 13*b* is communicated with outside the mold member 13 through horizontal and vertical passages 13*c* and 13*d*. Second starting magnet 14*b* is housed in open chamber 13*b* in such a way that it can move to and from second reed switch 11 in upward and downward directions (shown by arrows in FIG. 6). Second starting magnet 14*b* is plate-shaped and its lower side serves as N polarity while its upper side as S polarity. It is embedded in float 21 with its top exposed.

Figure 6:
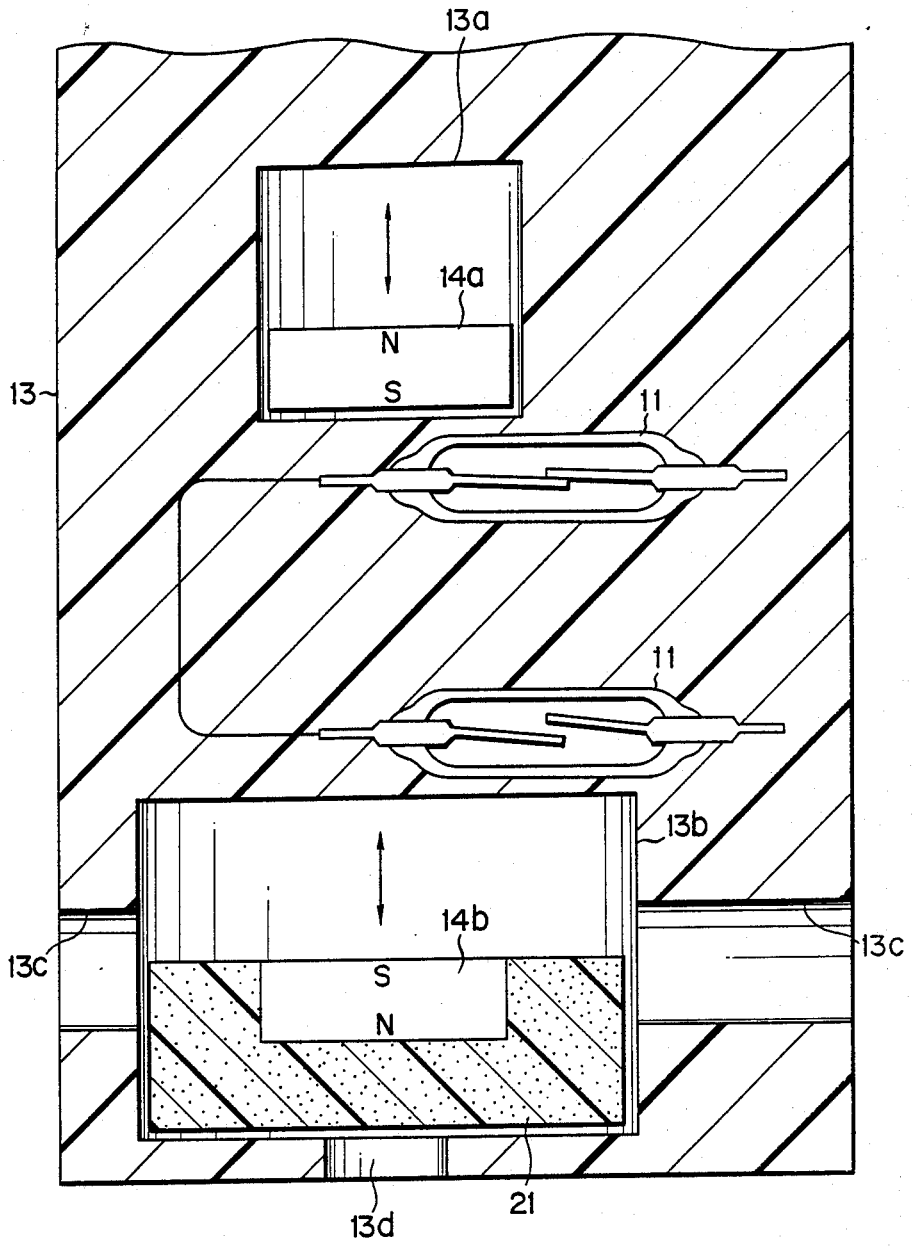
FIG. 6 is a sectional view showing a second embodiment of the switching device according to the present invention.

When the switching device having the above-described arrangement is as shown in FIG. 6, first reed switch is closed by the electric field of first starting magnet 14*a* which is in the stable operation area but second reed switch 11 is opened because it is out of the influence of the electric field of second starting magnet 14*b* which is in the unstable operation area. Since reed switches 11 are connected in series, the line of these reed switches 11 is opened. When the switching device is put into the sea, first starting magnet 14*a* is held close to first reed switch 11 due to its own weight, thereby keeping first reed switch 11 closed, while second starting magnet 14*b* is lifted close to second reed switch 11 and brought into the stable operation area by float 21 on the water entering into open chamber 13*b*, thereby causing second reed switch 11 to be closed. As a result, the line of reed switches 11 is closed, rendering an electric circuit (not shown) operative. When the switching device is turned upside down in the sea, first starting magnet 14*a* moves away from first reed switch 11 thanks to its own weight to thereby open this reed switch 11, while second starting magnet 14*b* is carried away from second reed switch 11 by float 21 to thereby open this reed switch 11. The switching device is in an on-state when it is kept right side up in the sea, but it is in an off-state when it is turned upside down in the sea.

A radio buoy into which the second embodiment of the switching device is incorporated and which serves as the sea rescue safety system will be described with reference to FIG. 7.

Numeral 13 represents a body case of the radio buoy (which corresponds to mold member 13). The switching device shown in FIG. 6 is arranged in the bottom of the body case and connected to electric circuits (not shown) in the body case.

Figure 7:
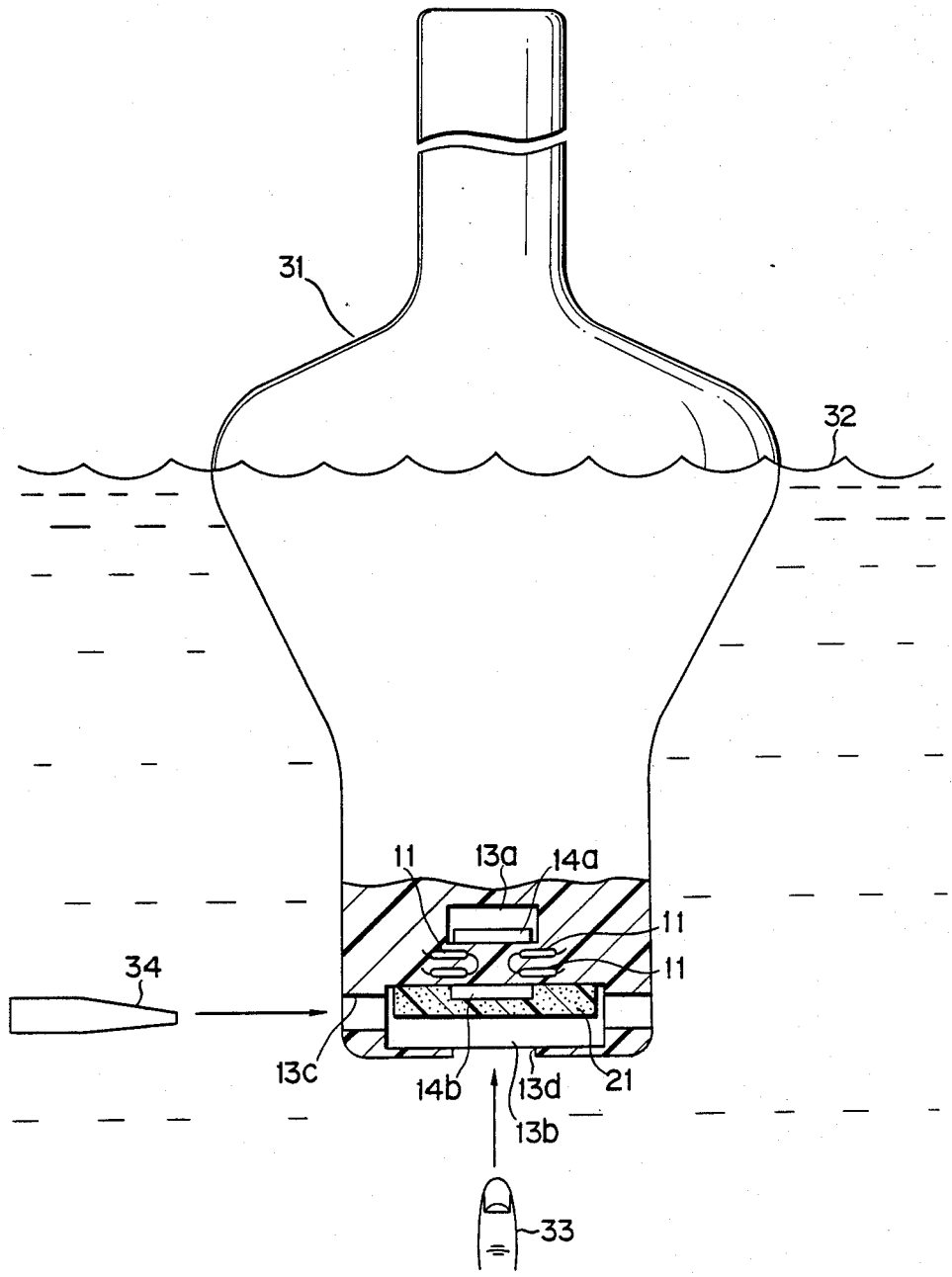
FIG. 7 is a partially broken front view showing a radio buoy into which the second embodiment of the switching device is incorporated.

This radio buoy floats right side up on sea 32 as shown in FIG. 7 and sea water enters into open chamber 13*b* through horizontal and vertical passages 13*c* and 13*d* in the bottom of the body case. First starting magnet 14*a* comes close to first reed switches 11 due to its own weight, thereby closing these reed switches 11, while second starting magnet 14*b* is brought close to second reed switches 11 by float 21 on the sea water entering into open chamber 13*b*, thereby closing these reed switches 11. Therefore, the radio buoy can be easily rendered operative only by dropping it into the sea.

When the radio buoy is pulled up from the sea, float 21 loses its buoyancy and second starting magnet 14*b* thus moves downward due to its own weight and comes remote from second reed switches 11, thereby opening these reed switches 11. Therefore, the radio buoy can be rendered inoperative only by pulling it up from the sea.

When the radio buoy is turned upside down, first starting magnet 14*a* moves downward due to its own weight and comes remote from first reed switches 11 to thereby open these reed switches 11. Even when the buoy is mistakenly turned upside down, therefore, it can be kept inoperative.

When the radio buoy which is kept right side up is to be manually operated, the float is lifted by a finger 33 through vertical passage 13*d* in the bottom of the body case and brought close to second reed switches 11. These second reed switches 11 are thus turned on to thereby make the electric circuits operative. When the radio buoy is not used, a fixing member such as safety pin 34 is inserted between the ceiling of the open chamber and second starting magnet 14*b* through horizontal passage 13*c* in the bottom of the body case. Second starting magnet 14*b* is thus locked, thereby preventing the radio buoy from being mistakenly rendered operative.

What is claimed is:

1. A switching device comprising at least one switch turned on and off by a magnetic field, a fixed bias magnet located in an area where said switch operates stably, and a starting magnet located opposite to the fixed bias magnet with the switch interposed between the fixed magnet and the starting magnet and capable of applying a magnetic field, reverse to that of the fixed bias magnet, to the switch, wherein when said starting magnet is close to the switch, its magnetic field overcomes that of the fixed bias magnet to control the switching-on and -off of the switch, and when the starting magnet is remote from the switch, the fixed bias magnet controls the switching-on and -off of the switch, wherein said at least one switch comprises plural reed switches arranged with one end of each of the reed switches closer to one another than the other end of each of the reed switches are to one another, and wherein the fixed bias and starting magnets are common to said reed switches and are located adjacent said one end of said reed switches which are arranged closer to each other.

2. A switching device according to claim 1, wherein said reed switches are each arranged to radially extend around a point and said fixed bias and starting magnets have a common axis passing through said point.

3. A switching device comprising first and second switches connected in series and turned on and off by a magnetic field, and first and second magnets each movable between an area where a corresponding switch thereof operates stably and another area where the corresponding switch thereof operates unstably, so as to control the switching-on and -off of the corresponding switch thereof by movement of one of said magnets to and from the corresponding switch thereof, wherein said first magnet includes means for coming close to and moving remote from said first switch due to the weight of said first magnet and said second magnet includes means for coming close to and remote from said second switch due to buoyancy.

4. A switching device according to claim 3, wherein said switches are of the normal open type and are turned on when said magnet comes close thereto.

5. A switching device according to claim 3, further including a body case having a first chamber and a second chamber having means for communication with liquid outside the body case, wherein said first switch is located adjacent to the first chamber in the body case and said second switch adjacent to the second chamber, and said first magnet is kept movable in the first chamber while said second magnet movable in the second chamber.

6. A switching device according to claim 5, further including a float movable in the second chamber to apply buoyancy to the second magnet on water.

7. A switching device, comprising:

a casing;

at least one switch provided in the casing and turned on and off by a magnetic field;

a fixed bias magnet provided in the casing and fixed in an area where said switch operates stably;

a starting magnet magnetically attracted by the fixed bias magnet to be attracted to the outside of the casing, so that it is located opposite to the fixed bias magnet with the switch interposed between the fixed magnet and the starting magnet, the starting magnet being capable of applying a magnetic field, reverse to that of the fixed bias magnet, to the switch, and the magnetic field of the starting magnet overcomes that of the fixed bias magnet to control the switching-on and -off of the switch; and means for separating the starting magnet from the outside of the casing, so that the fixed bias magnet controls the switching-on and -off of the switch.

8. A switching device according to claim 7, wherein each said reed switch has a pair of terminals provided with contacts, and an envelope for housing these terminals, and said fixed bias and starting magnets are located eccentric to the contacts.

9. A switching device according to claim 8, wherein said reed switch is of the normal open type and said fixed bias magnet applies said magnetic field to the reed switch to close the latter.

10. A switching device according to claim 9, wherein said fixed bias and starting magnets are reverse in polarity at their sides which are in facing opposition to each other.

* * * * *